US009410759B2

(12) United States Patent
Smith, Jr.

(10) Patent No.: US 9,410,759 B2
(45) Date of Patent: Aug. 9, 2016

(54) BURST FIRING DEVICE FOR FIREARM

(71) Applicant: Michael S. Smith, Jr., St. Augustine, FL (US)

(72) Inventor: Michael S. Smith, Jr., St. Augustine, FL (US)

( * ) Notice: Subject to any disclaimer, the term of this patent is extended or adjusted under 35 U.S.C. 154(b) by 0 days.

(21) Appl. No.: 14/682,426

(22) Filed: Apr. 9, 2015

(65) Prior Publication Data

US 2016/0202010 A1 Jul. 14, 2016

Related U.S. Application Data

(60) Provisional application No. 62/103,394, filed on Jan. 14, 2015.

(51) Int. Cl.

| | |
|---|---|
| ***F41A 19/59*** | (2006.01) |
| ***F41A 19/10*** | (2006.01) |
| ***F41A 19/12*** | (2006.01) |
| ***F41A 19/14*** | (2006.01) |

(52) U.S. Cl.
CPC ..... *F41A 19/10* (2013.01); *F41A 19/12* (2013.01); *F41A 19/14* (2013.01)

(58) Field of Classification Search
CPC ..... F41A 19/69; F41A 19/02; F41A 19/06; F41A 19/58; F41A 17/06
USPC ..... 42/69.01; 89/128–131
See application file for complete search history.

(56) References Cited

U.S. PATENT DOCUMENTS

| | | | | |
|---|---|---|---|---|
| 3,292,492 | A * | 12/1966 | Sturtevant | F41A 17/46 89/128 |
| 3,774,500 | A * | 11/1973 | Into | F41A 19/02 89/129.01 |
| 4,004,496 | A * | 1/1977 | Snodgrass | F41A 19/02 89/129.02 |
| 4,510,844 | A * | 4/1985 | Fritz | F41A 19/62 89/129.02 |
| 7,878,106 | B2 * | 2/2011 | Hu | F41A 19/02 89/129.02 |
| 8,807,007 | B2 * | 8/2014 | Alicea | F41A 17/06 89/28.1 |
| 9,151,559 | B2 * | 10/2015 | Alicea, Jr. | F41A 17/06 |
| 2010/0186277 | A1 * | 7/2010 | Beckmann | F41A 19/69 42/69.01 |
| 2013/0118050 | A1 * | 5/2013 | Alicea | F41A 17/06 42/84 |
| 2015/0241156 | A1 * | 8/2015 | Alicea, Jr. | F41A 17/06 89/28.1 |

* cited by examiner

*Primary Examiner* — Michael David
(74) *Attorney, Agent, or Firm* — Dunlap Bennett & Ludwig PLLC

(57) ABSTRACT

A burst firing trigger mechanism is provided. The mechanism includes a sear having a hamper engagement surface and a transfer mechanism. The present invention further includes a plurality of triggers. The plurality of triggers each includes a lever, a base pivotally attached to the sear by a pivot pin, and a trip finger extending from the base. Each of the trip fingers extends at a different angle relative to the lever. The present invention further includes a hammer biased by a spring away from the sear. The hammer includes a cocking notch. The burst firing trigger mechanism includes a cocked position and a plurality of fired positions. The cocked position includes the hammer engagement surface engaging the cocking notch and suspending the hammer towards the sear. Each of the plurality of fired positions includes the plurality of triggers pivoted so that at least one of the trip fingers engages the transfer mechanism thereby disengaging the hammer engagement surface from the cocking notch and thereby releasing the hammer.

8 Claims, 8 Drawing Sheets

BURST FIRING DEVICE FOR FIREARM

CROSS-REFERENCE TO RELATED APPLICATION

This application claims the benefit of priority of U.S. provisional application No. 62/103,394, filed Jan. 14, 2015, the contents of which are herein incorporated by reference.

BACKGROUND OF THE INVENTION

The present invention relates to a burst firing device for firearms and, more particularly, to a burst firing device utilizing more than one trigger.

In automatic firearms, burst mode or burst fire is a firing mode enabling the shooter to fire a predetermined number of rounds, usually two or three rounds on hand held weapons, with a single pull of the trigger. This firing mode is commonly used in submachine guns, assault rifles, and carbines. Other types of firearms, such as machine pistols may also have a burst mode.

Currently, a private citizen may have difficulty obtaining a burst fire automatic rifle. The burst fire weapons cost a lot of money, and the gun must be made before May 19, 1986, meaning that there is a finite supply of these particular firearms. With more collectors buying the burst fire rifles and keeping them, the availability of them has drastically gone down. There is the bump fire stock version; however the bump fire stock requires excellent technique and practice. Therefore, the bump fire stock may only fire one bullet at a time if not used properly. Further, the bump fire stock is inaccurate and is unreliable.

As can be seen, there is a need for a reasonably affordable and safe burst firing weapon.

SUMMARY OF THE INVENTION

In one aspect of the present invention, a burst firing trigger mechanism comprises: a sear comprising a hammer engagement surface and a transfer mechanism; at least one trigger comprising, a lever, a base pivotally attached to the sear, and a plurality of trip fingers extending from the base, wherein each trip finger extends at a different angle relative to the lever; and a hammer biased by a spring away from the sear and comprising a cocking notch, wherein the burst firing trigger mechanism comprises a cocked position and a plurality of fired positions, wherein the cocked position comprises the hammer engagement surface engaging the cocking notch and suspending the hammer towards the sear, wherein each of the plurality of fired positions comprises the at least one trigger pivoted, wherein at least one of the trip finger engages the transfer mechanism thereby disengaging the hammer engagement surface from the cocking notch and thereby releasing the hammer.

These and other features, aspects and advantages of the present invention will become better understood with reference to the following drawings, description and claims.

DETAILED DESCRIPTION OF THE INVENTION

Figure 1:
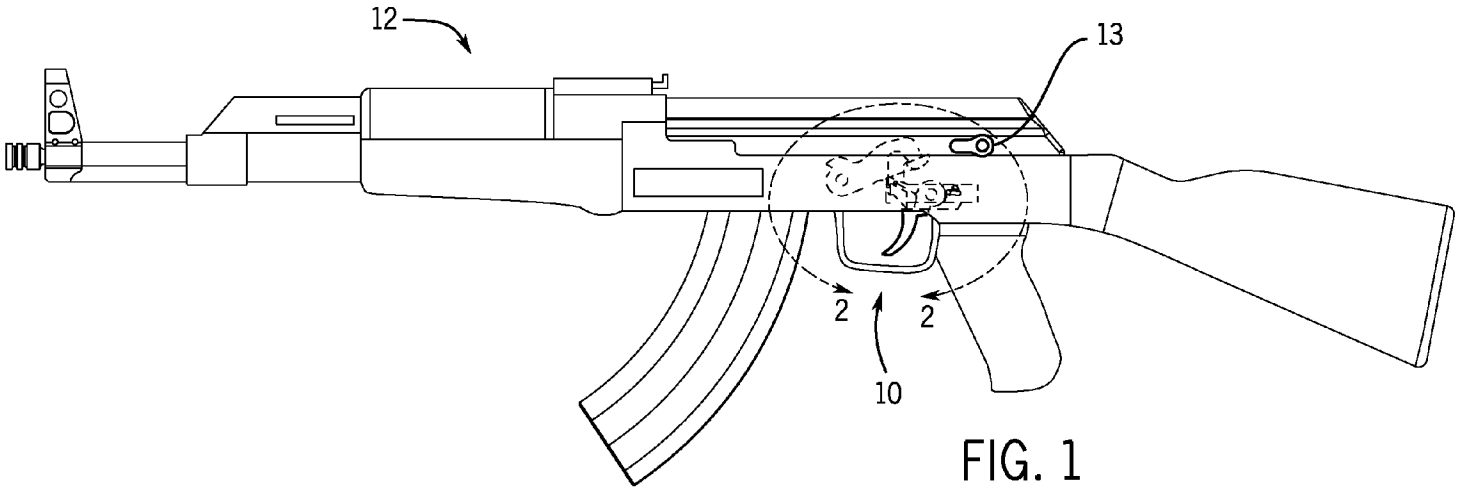
FIG. 1 is a side elevation view of the first embodiment of the present invention incorporated on an AK-47 semi-automatic rifle.
Figure 4:
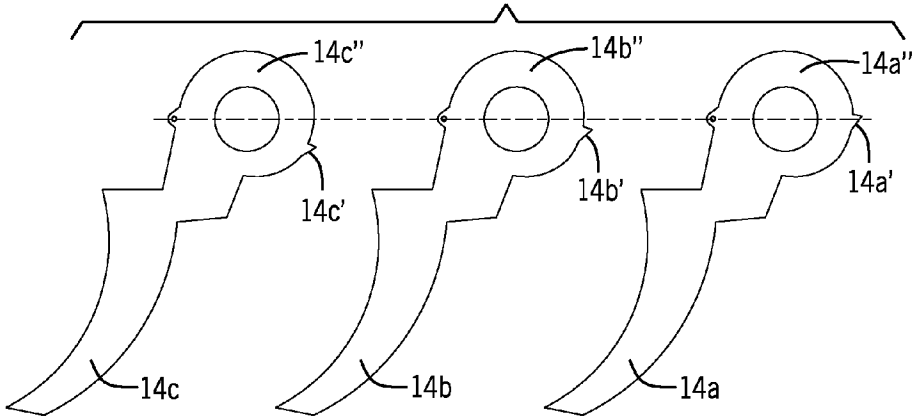
FIG. 4 is an elevation view comparing the geometry of the three triggers of the first embodiment.
Figure 2:
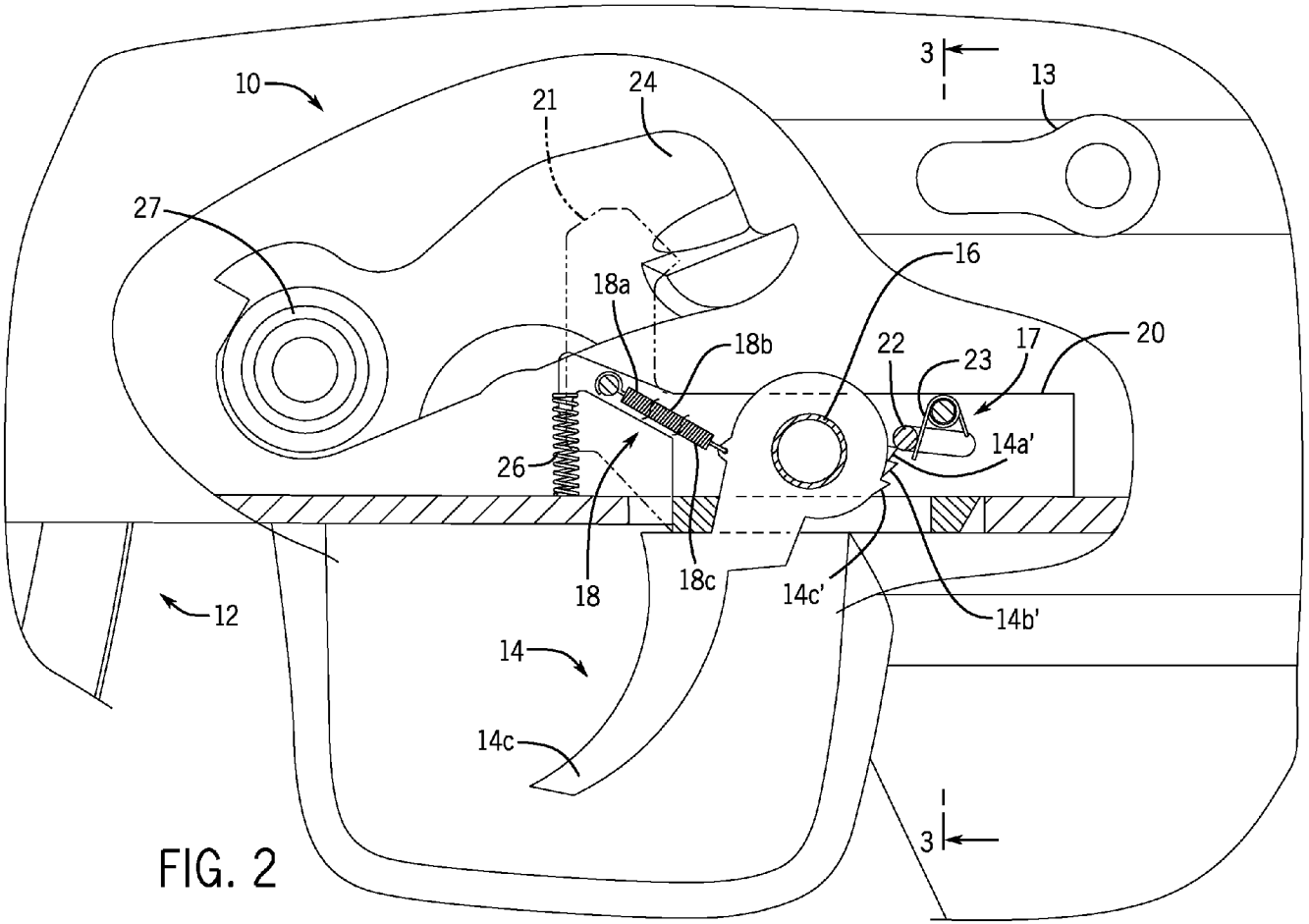
FIG. 2 is a detail side elevation view with parts broken away, indicated by line 2-2 of FIG. 1.
Figure 3:
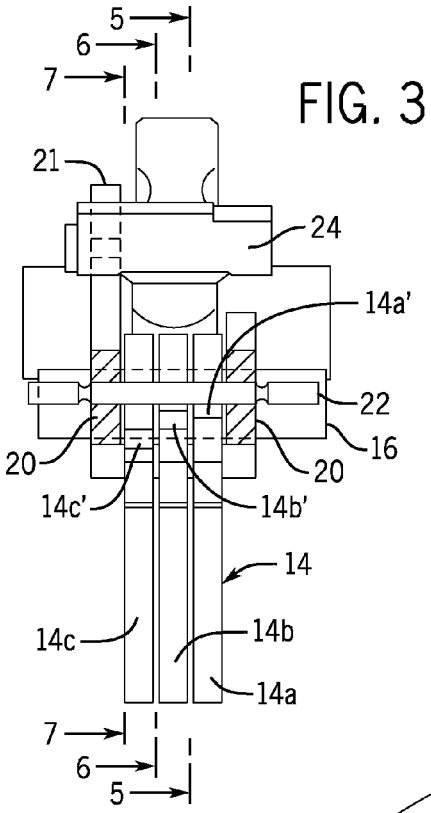
FIG. 3 is a cross-sectional view taken on line 3-3 of FIG. 2.
Figure 5:
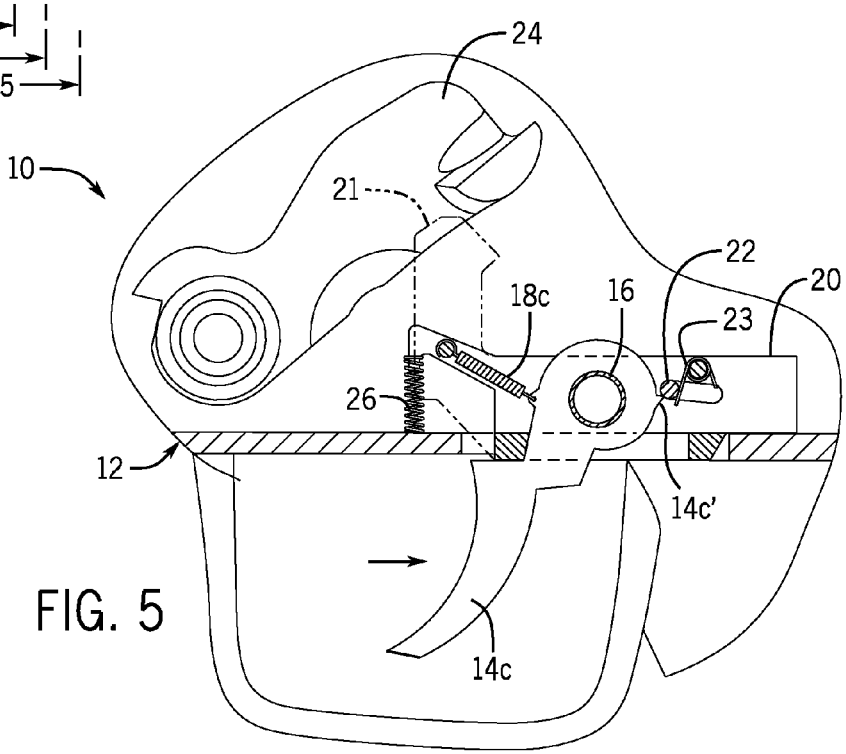
FIG. 5 is a cross-sectional view taken on line 5-5 of FIG. 3.
Figure 6:
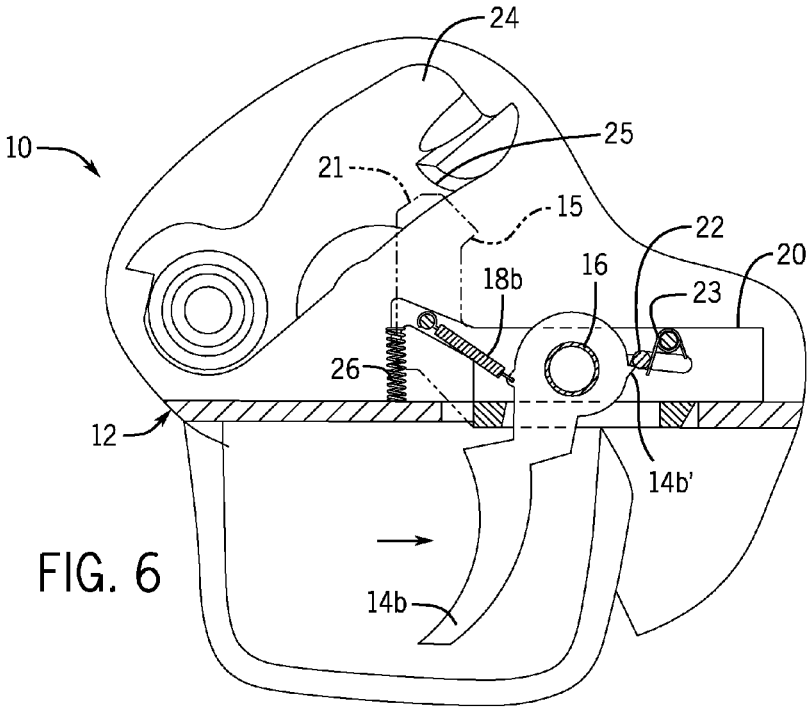
FIG. 6 is a cross-sectional view taken on line 6-6 of FIG. 3.
Figure 7:
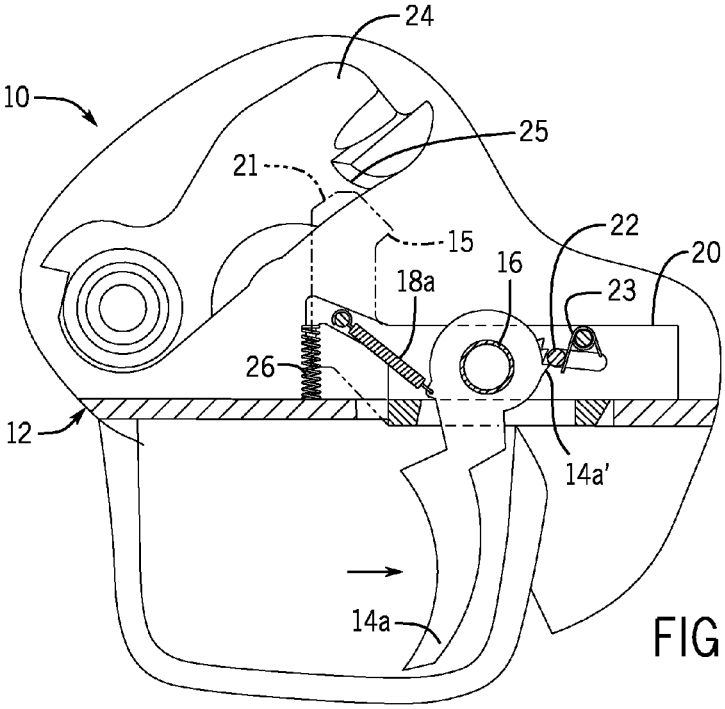
FIG. 7 is a cross-sectional view taken on line 7-7 of FIG. 3.
Figure 8:
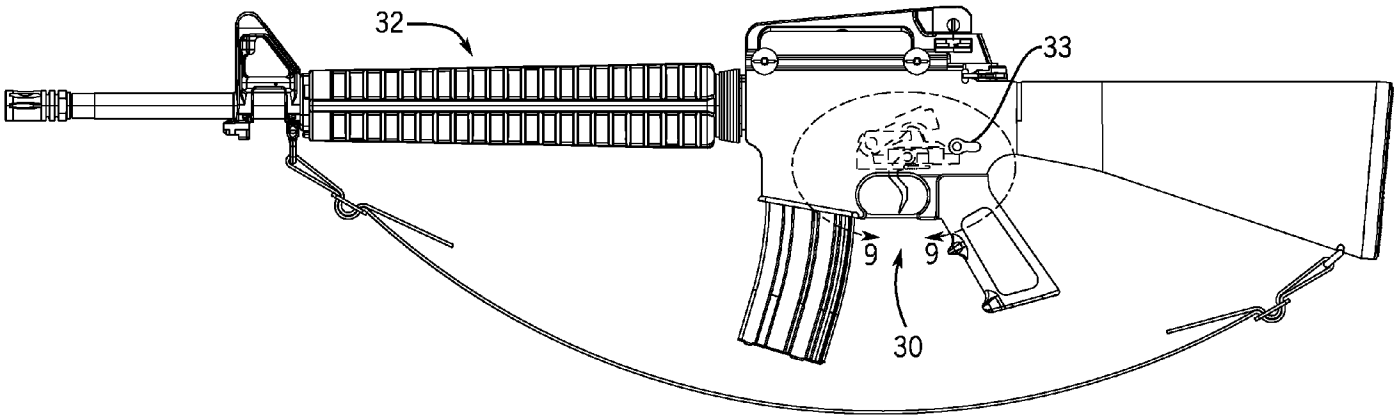
FIG. 8 is a side elevation view of the second embodiment of the present invention incorporated on an AR-15 semi-automatic rifle.
Figure 11:
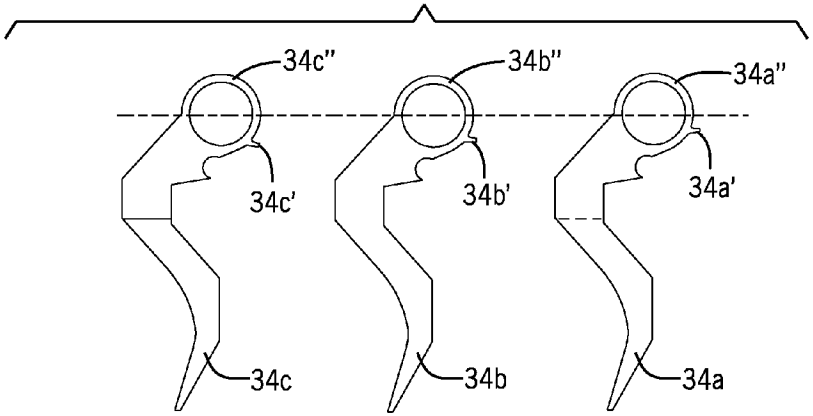
FIG. 11 is an elevation view comparing the geometry of the three triggers of the second embodiment.
Figure 9:
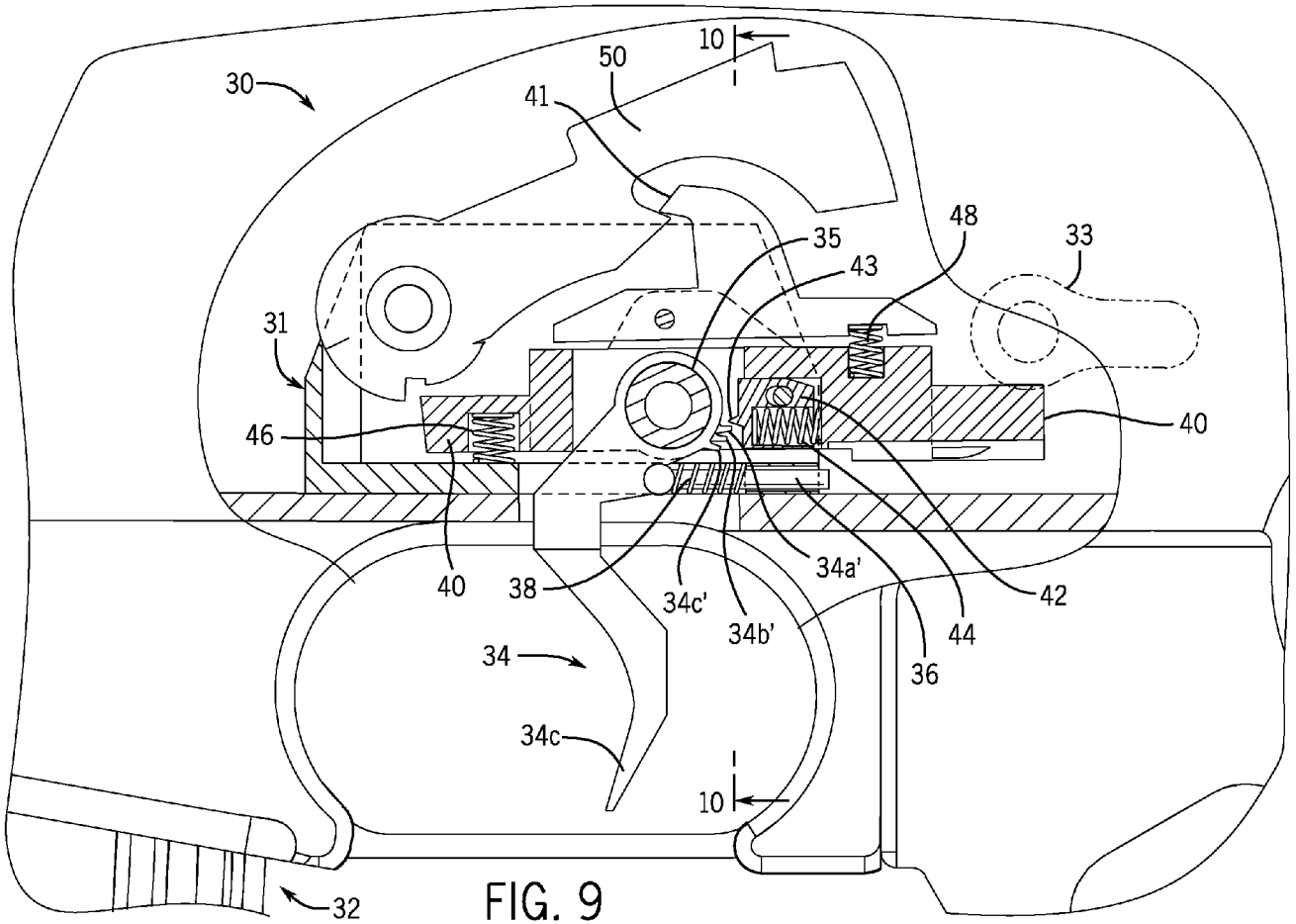
FIG. 9 is a detail side elevation view with parts broken away, indicated by line 9-9 of FIG. 8.
Figure 10:
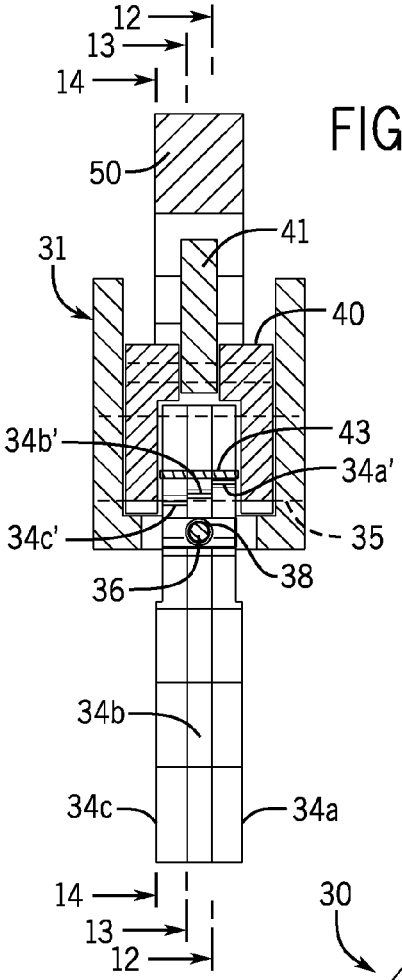
FIG. 10 is a cross-sectional view taken on line 10-10 of FIG. 9.
Figure 12:
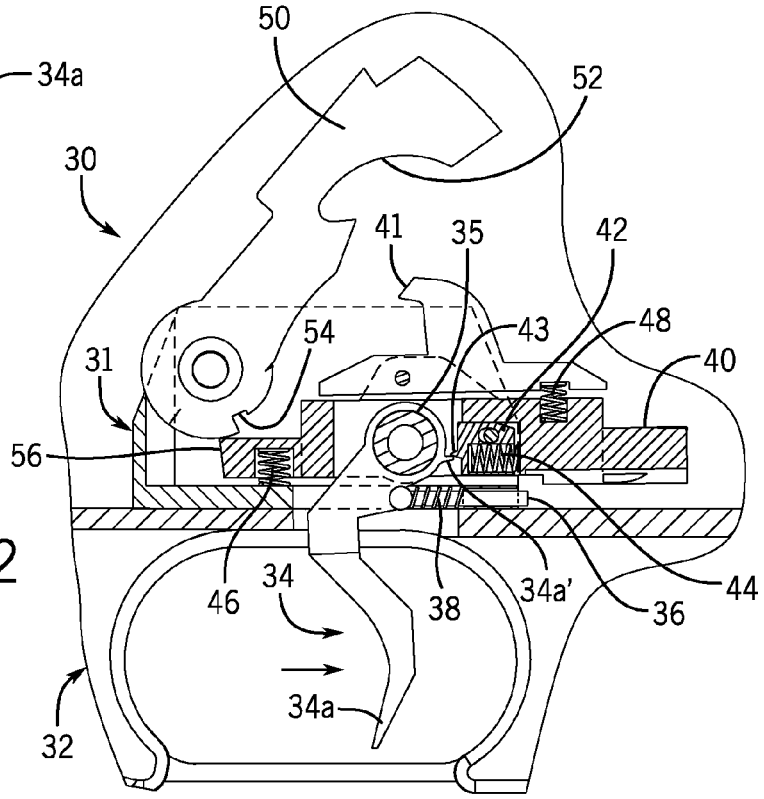
FIG. 12 is a cross-sectional view taken on line 12-12 of FIG. 10.
Figure 13:
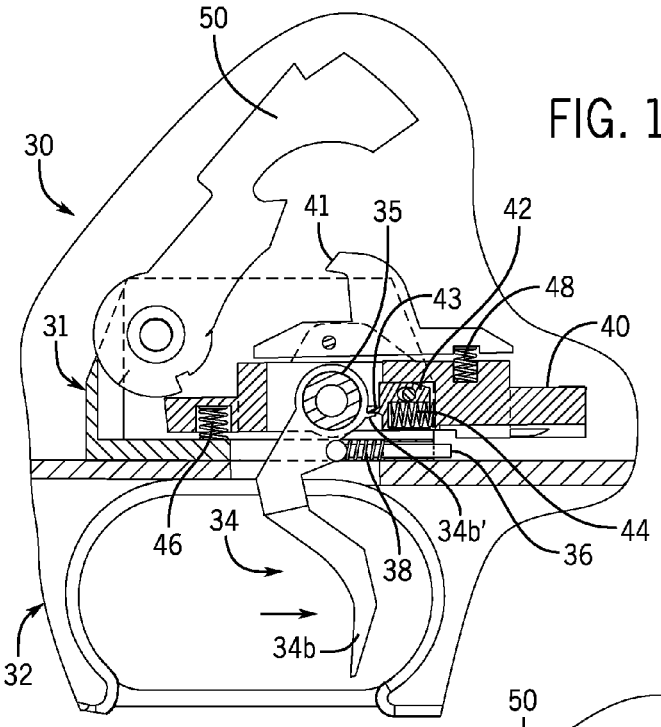
FIG. 13 is a cross-sectional view taken on line 13-13 of FIG. 10.
Figure 14:
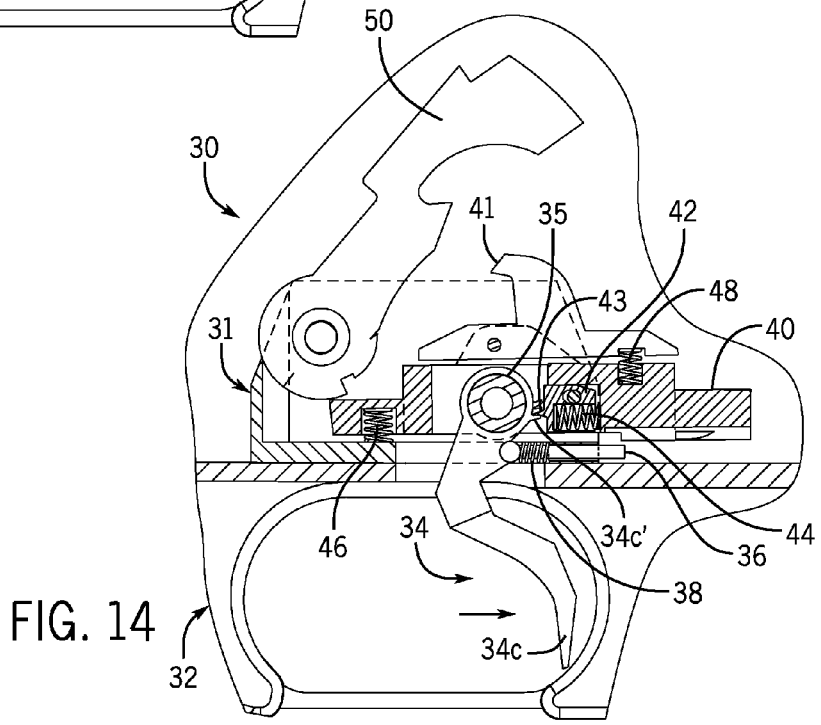
FIG. 14 is a cross-sectional view taken on line 14-14 of FIG. 10.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims Referring to FIGS. 1 through 14, the present invention includes a burst firing trigger mechanism 10. The mechanism 10 includes a sear 20 having a hammer engagement surface 15 and a transfer mechanism 17. The present invention further includes at least one trigger 14, such as a plurality of triggers 14. The plurality of triggers 14 each include a lever 14*a*, a base 14*a*" pivotally attached to the sear 20 by a pivot pin 16, and a trip finger 14*a*' extending from the base 14*a*". Each of the trip fingers 14*a*' extends at a different angle relative to the lever 14*a*. The present invention further includes a hammer 24 biased by a spring 27 away from the sear 20. The hammer 24 includes a cocking notch 25. The burst firing trigger mechanism 10 includes a cocked position and a plurality of fired positions. The cocked position includes the hammer engagement surface 15 engaging the cocking notch 25 and suspending the hammer 24 towards the sear 20. Each of the plurality of fired positions includes the plurality of triggers 14 pivoted so that at least one of the trip fingers 14*a*', 14*b*', 14*c*' engages the transfer mechanism 17 thereby disengaging the hammer engagement surface 15 from the cocking notch 25 and thereby releasing the hammer 20.

Referring to FIGS. 1 through 7, the present invention may be utilized with an AK-47 rifle 12. The rifle 12 includes a trigger mechanism 10 and a safety 13. The sear 20 of the AK-47 utilizes a latch mechanism 21. The present invention may include three triggers 14*a*, 14*b*, 14*c*. The triggers 14*a*, 14*b*, 14*c* are spring biased in the cocked position by springs 18, such as a first spring 18*a*, a second spring 18*b*, and a third spring 18*c* each attached to each of the three triggers 14*a*, 14*b*, 14*c*. The sear 20 of the present invention may also be spring biased in a cocked position by a spring 26. The hammer 24 is spring biased in the firing position by a spring 27. The three triggers 14*a*, 14*b*, 14*c* include three degrees of pivoting. A first degree of pivoting includes the first trip finger 14*a*' engaging the transfer mechanism 17, a second degree of pivoting includes the second trip finger 14*b*' engaging the transfer mechanism 17, and a third degree of pivoting includes the third trip finger 14*c*' engaging the transfer mechanism 17.

In certain embodiment, the transfer mechanism 17 includes a transfer pin 22 suspended within a slot formed in the sear 20. A torsion spring 23 biases the transfer pin 22 towards the bases 14*a*", 14*b*", 14*c*" of the triggers 14*a*, 14*b*, 14*c*.

The triggers 14*a*, 14*b*, 14*c* align with one another, and are thereby pulled at the same time. After the first degree of pivoting is applied, the first trigger 14*a* presses the first trip finger 14*a*' against the transfer pin 22, pushing the transfer pin 22 back into the slot and rotating the sear 20 away from the hammer 24. The hammer engagement surface 15 disengages from the cocking notch 25, releasing the hammer 24, and thereby firing the rifle 12. The bolt of the rifle 12 pushes the hammer 24 back down so that the hammer engagement surface 15 engages the cocking notch 25. After the second degree of pivoting is applied, the second trigger 14*b* presses the second trip finger 14*b*' against the transfer pin 22, pushing the transfer pin 22 back into the slot and rotating the sear 20 away from the hammer 24. The hammer engagement surface 15 disengages from the cocking notch 25, releasing the hammer 24, and thereby firing the rifle 12. The bolt of the rifle 12 pushes the hammer 24 back down so that the hammer engagement surface 15 engages the cocking notch 25. After the third degree of pivoting is applied, the third trigger 14*c* presses the third trip finger 14*c*' against the transfer pin 22, pushing the transfer pin 22 back into the slot and rotating the sear 20 away from the hammer 24. The hammer engagement surface 15 disengages from the cocking notch 25, releasing the hammer 24, and thereby firing the rifle 12. The bolt of the rifle 12 pushes the hammer 24 back down so that the hammer engagement surface 15 engages the cocking notch 25.

Referring to FIGS. 8 through 14, the present invention may be utilized with an AR-15 ® rifle 32. The rifle 32 includes a trigger mechanism 30 and a safety 33. The present invention may include three triggers 34*a*, 34*b*, 34*c*. The triggers 34*a*, 34*b*, 34*c* are spring biased in the cocked position by a trigger bar 36 and a bar spring 38 spring biasing the trigger bar 36 against the triggers 34. The sear 20 of the present invention may also be spring biased in a cocked position by a spring 46. The hammer 50 is spring biased in the firing position by a spring 57. The three triggers 34*a*, 34*b*, 34*c* include three degrees of pivoting. The first degree of pivoting includes the first trip finger 34*a*' engaging the transfer mechanism 17, a second degree of pivoting includes a second trip finger 34*b*' engaging the transfer mechanism 17, and a third degree of pivoting includes a third trip finger 34*c*' engaging the transfer mechanism 17.

The sear 20 of the present invention may be contained within a trigger group body 31. In certain embodiment, the transfer mechanism 17 includes a transfer block 42 having a transfer block finger 43. A spring 44 biases the transfer block 42 towards the bases 34*a*", 34*b*", 34*c*" of the triggers 34*a*, 34*b*, 34*c*. The trigger mechanism 30 may further include a disconnect 41 suspended on top of the sear 20 by a spring 48. The hammer 50 includes a disconnect receiver 52 positioned to secure the disconnect 41 within during a transition between the cocked position and the fired position.

The triggers 34*a*, 34*b*, 34*c* align with one another, and are thereby pulled at the same time. After the first degree of pivoting is applied, the first trigger 34*a* presses the first trip finger 34*a*' against the transfer block finger 43, pushing the transfer block 42 against the sear 20, thereby pushing the hammer engagement surface 15 away from the cocking notch 25. The hammer engagement surface 15 disengages from the cocking notch 25, releasing the hammer 50, and thereby firing the rifle 32. The bolt of the rifle 12 pushes the hammer 50 back down so that the disconnect 41 enters the disconnect receiver 52 and retains the hammer 50 in the cocked position. After the second degree of pivoting is applied, the second trigger 34*b* presses the second trip finger 34*b*' against the transfer block finger 43, pushing the transfer block 42 against the sear 20, thereby pushing the disconnect 41 away from the disconnect receiver 52. The disconnect 41 disengages from the disconnect receiver 52, releasing the hammer 50 and thereby firing the rifle 32. After the third degree of pivoting is applied, the third trigger 34*c* presses the third trip finger 34*c*' against the transfer block finger 43, pushing the transfer block 42 against the sear 20, thereby pushing the disconnect 41 away from the disconnect receiver 52. The disconnect 41 disengages from the disconnect receiver 52, releasing the hammer 50 and thereby firing the rifle 32.

It should be understood, of course, that the foregoing relates to exemplary embodiments of the invention and that modifications may be made without departing from the spirit and scope of the invention as set forth in the following claims.

What is claimed is:

1. A burst firing trigger mechanism comprising:

a sear comprising a hammer engagement surface and a transfer mechanism;

at least one trigger comprising, a lever, a base pivotally attached to the sear, and a plurality of trip fingers extending from the base, wherein each trip finger extends at a different angle relative to the lever; and a hammer biased by a spring away from the sear and comprising a cocking notch, wherein the burst firing trigger mechanism comprises a cocked position and a plurality of fired positions, wherein the cocked position comprises the hammer engagement surface engaging the cocking notch and suspending the hammer towards the sear, wherein each of the plurality of fired positions comprises the at least one trigger pivoted, wherein at least one of the trip finger engages the transfer mechanism thereby disengaging the hammer engagement surface from the cocking notch and thereby releasing the hammer.

2. The burst firing trigger mechanism of claim 1, wherein the at least one trigger comprises a plurality of triggers each comprising one of the plurality of trip fingers.

3. The burst firing trigger mechanism of claim 2, wherein the plurality of triggers is three triggers.

4. The burst firing trigger mechanism of claim 1, wherein the at least one trigger comprises three degrees of pivoting, wherein a first degree of pivoting comprises a first trip finger engaging the transfer mechanism, a second degree of pivoting comprises a second trip finger engaging the transfer mechanism, and a third degree of pivoting comprises a third trip finger engaging the transfer mechanism.

5. The burst firing trigger mechanism of claim 1, wherein the transfer mechanism comprises a transfer pin and a torsion spring biasing the transfer pin towards the bases, wherein pulling the at least one trigger presses at least one of the trip fingers against the transfer pin and thereby rotates the sear away from the hammer.

6. The burst firing trigger mechanism of claim 1, wherein the at least one trigger and the sear is spring biased in a cocked position, and the hammer is spring biased in the firing position.

7. The burst firing trigger mechanism of claim 1, further comprising a disconnect suspended on top of the sear by a spring, wherein the hammer comprises a disconnect receiver positioned to secure the disconnect within during a transition between the cocked position and the fired position.

8. The burst firing trigger mechanism of claim 1, wherein the transfer mechanism comprises a transfer block comprising a transfer block finger and a spring biasing the transfer block towards the base, wherein pulling the at least one trigger presses at least one of the trip fingers against the transfer block finger and pushes the transfer block against the sear, thereby pushing the hammer engagement surface away from the cocking notch.

* * * * *